US008382056B2

(12) United States Patent
Le Masurier et al.

(10) Patent No.: US 8,382,056 B2
(45) Date of Patent: Feb. 26, 2013

(54) SAFETY DEVICE

(76) Inventors: Steven Le Masurier, Channel Islands (GB); John Phillips, Channel Islands (GB)

( * ) Notice: Subject to any disclaimer, the term of this patent is extended or adjusted under 35 U.S.C. 154(b) by 1 day.

(21) Appl. No.: 12/310,606

(22) PCT Filed: Aug. 28, 2007

(86) PCT No.: PCT/GB2007/003262

§ 371 (c)(1),
(2), (4) Date: Sep. 30, 2010

(87) PCT Pub. No.: WO2008/025979

PCT Pub. Date: Mar. 6, 2008

(65) Prior Publication Data

US 2011/0012002 A1 Jan. 20, 2011

(30) Foreign Application Priority Data

Aug. 29, 2006 (GB) ..... 0617005.4

(51) Int. Cl.
*A47B 91/00* (2006.01)

(52) U.S. Cl. ..... 248/346.03; 248/188.3; 248/295.11; 182/200; 182/2.2

(58) Field of Classification Search ..... 182/111, 182/200, 204; 248/188.3, 295.11, 346.03
See application file for complete search history.

(56) References Cited

U.S. PATENT DOCUMENTS 666,526 A * 1/1901 Howard ..... 182/169
718,602 A * 1/1903 Chase ..... 248/237
1,028,362 A * 6/1912 King ..... 182/45
1,780,386 A 11/1930 Harrison
2,549,638 A * 4/1951 Rogghe ..... 248/237
3,164,353 A * 1/1965 Rene ..... 248/237
3,199,629 A * 8/1965 Fagaly ..... 182/200
3,526,296 A * 9/1970 Stevens ..... 182/45
3,937,298 A * 2/1976 Hurwitz ..... 182/200
4,069,893 A * 1/1978 Blackstone ..... 182/200
4,397,373 A * 8/1983 Ream et al. ..... 182/17
4,498,556 A * 2/1985 Garton ..... 182/19
4,679,652 A 7/1987 Cervantes, Sr.
4,993,514 A * 2/1991 Ferguson ..... 182/200
5,115,886 A * 5/1992 Sakamoto et al. ..... 182/36
5,318,148 A * 6/1994 Franco et al. ..... 182/45

(Continued)

FOREIGN PATENT DOCUMENTS

FR 2853688 10/2004
FR 2857403 A1 * 1/2005

(Continued)

OTHER PUBLICATIONS

International Search Report, PCT/GB2007/003262, 3 pp. (Jul. 12, 2007).
Written Opinion, PCT/GB2007/003262, 6 pp. (Jul. 12, 2007).
Search Report, GB0617005.4, 1 p. (Dec. 22, 2006).
Examination Report, GB0617005.4, 2pp. (Nov. 22, 2010).
Examination Report, GB0804323.4, 3pp. (Nov. 22, 2010).

*Primary Examiner* — Terrell McKinnon
*Assistant Examiner* — Daniel J Breslin
(74) *Attorney, Agent, or Firm* — Klarquist Sparkman, LLP

(57) ABSTRACT

A safety device, comprising: a mounting arrangement operable to receive and support a lower portion of a ladder; and a support assembly upon which the device may rest, the support assembly comprising a plurality of elongate support members, each of which has a pair of ground contacting locations on which the device may rest and is independently pivotable with respect to the mounting arrangement around a point located between the ground contacting locations.

18 Claims, 8 Drawing Sheets

U.S. PATENT DOCUMENTS

| | | | | | |
|---|---|---|---|---|---|
| 5,339,921 | A | * | 8/1994 | Faupel | 182/111 |
| 5,507,364 | A | * | 4/1996 | Spevak | 182/200 |
| 5,669,462 | A | * | 9/1997 | Jennings | 182/111 |
| 5,771,992 | A | * | 6/1998 | Snyder | 182/200 |
| 5,791,438 | A | * | 8/1998 | Kempton | 182/200 |
| 5,803,204 | A | * | 9/1998 | White et al. | 182/148 |
| 5,960,904 | A | * | 10/1999 | Ullmann | 182/45 |
| 6,003,823 | A | * | 12/1999 | Hoffman | 248/163.2 |
| 6,053,284 | A | * | 4/2000 | Fountain | 182/180.2 |
| 6,269,905 | B1 | * | 8/2001 | Smith | 182/45 |
| 6,543,733 | B1 | * | 4/2003 | Pennington | 248/149 |
| 6,547,036 | B1 | * | 4/2003 | Carter | 182/200 |
| 7,344,482 | B2 | * | 3/2008 | Checketts | 482/55 |
| 2006/0219478 | A1 | * | 10/2006 | Severs et al. | 182/2.9 |
| 2008/0105489 | A1 | * | 5/2008 | Garrett | 182/45 |

FOREIGN PATENT DOCUMENTS

| | | | |
|---|---|---|---|
| GB | 1154440 | | 6/1969 |
| GB | 2014638 | | 8/1979 |
| GB | 2037357 | | 7/1980 |
| GB | 2155983 | | 10/1985 |
| GB | 2186903 | A * | 8/1987 |
| GB | 2260560 | | 4/1993 |
| GB | 2330611 | | 4/1999 |
| GB | 2336618 | A * | 10/1999 |
| JP | 11-324543 | | 4/2001 |
| WO | WO 92/00432 | | 1/1992 |

* cited by examiner

SAFETY DEVICE

CROSS REFERENCE TO RELATED APPLICATION

This is the U.S. National Stage of International Application No. PCT/GB2007/003262, filed Aug. 28, 2007, which claims the benefit of Great Britain Patent Application No. 0617005.4, filed Aug. 29, 2006.

DETAILED DESCRIPTION

THIS INVENTION relates to a safety device, and in particular concerns a device for improving the safety and security of a user while the user is climbing a ladder.

Ladders are used routinely both by construction and maintenance professionals and by home users. Accidents involving ladders are, however, common, and one recent study revealed that over 50 deaths and 12,000 accidents requiring hospital treatment arise each year from ladder-related incidents.

The DTI has conducted an assessment of leaning ladder safety devices, and this assessment concluded that many of the leaning ladder safety devices which are currently available have only limited effectiveness in reducing the dangers which are present when a ladder is utilised.

UK Patent No. 1154440 (Mason) describes a ladder stabilising device having legs arranged in a "X" or "Y" configuration, each leg terminating in a foot. Mason discloses that each of the feet may be provided on a hinged end portion of each leg, to assist in transportation or storage of the device. However, the device disclosed In Mason is insufficiently sturdy, and does not allow great flexibility In the placement of the feet.

International Patent Publication No. WO 92/00432 (Tagnon) discloses an adjustable scaffolding for allowing work to be carried out on a sloping surface or set of stairs. This device is, however, only useful for work on stairs or relatively steep slopes, and Is also ill-adapted for use with ladders.

It is an object of the present invention to seek to provide an improved safety device for use with a leaning ladder.

Accordingly, one aspect of the present invention provides a safety device, comprising: a mounting arrangement operable to receive and support a lower portion of a ladder; and a support assembly upon which the device may rest, the support assembly comprising a plurality of elongate support members, each of which has a pair of ground contacting locations on which the device may rest and is independently pivotable with respect to the mounting arrangement around a point located between the ground contacting locations.

Advantageously, the ground contacting locations of each support member are provided at or near opposite ends of the support member.

Preferably, the mounting arrangement comprises an elongate platform, and each support member may pivot into a position in which the support member is substantially parallel with the platform.

Conveniently, each support member may be locked in position.

Advantageously, at least one of the support members Is pivotably attached to the mounting arrangement at a point which is displaced from the centre of the length of the support member.

Preferably, at least one of the ground contacting locations comprising a foot upon which the device may rest.

Conveniently, the distance between the foot and the support member on which the foot is provided is adjustable.

Advantageously, the foot is connected to the support member in a universally-jointed manner.

Preferably, the foot comprises an anchoring device operable to penetrate into a surface on which the device is placed.

Conveniently, the anchoring device comprises one or more spikes and a flange, so that penetration of the one or more spikes into the surface will be halted when the flange comes to rest on the surface.

Advantageously, the foot is removable from the support member.

Preferably, the foot is not removable from the support member.

Conveniently, a plurality of interchangeable feet are provided.

Advantageously, the support assembly comprises one or more downwardly extending legs, each of which may be removably attached to one of the support members so that the support member may be supported by the downwardly extending leg rather than resting on one of the ground contacting locations of the support member.

Preferably, at least one elongate leg may be attached to extend downwardly from at least one of the support members, thereby allowing the device to rest on a pair of steps of different heights while maintaining the mounting arrangement in a substantially horizontal orientation.

Conveniently, the or each elongate leg terminates in a foot.

Advantageously, the distance by which the or each leg extends downwardly from the support member to which the leg Is attached is adjustable.

Preferably, the or each leg may be replaced, once removed from the support assembly, by a foot.

Conveniently, the mounting arrangement comprises a platform, upon which a lower portion of a ladder may rest, having at least one raised wall provided thereon, against which a lower portion of a ladder may abut.

Advantageously, the wall is provided along a longer edge of the platform.

Preferably, the mounting arrangement is provided with a pair of raised walls on opposite sides of the platform.

Conveniently, the support members are provided near respective first and second ends of the device, and at least one of the support members is provided on a support bracket, which is attached to the platform.

Advantageously, a support member at or near the first end of the device is provided on a support bracket, and the support bracket may be moved between a support position in which, a further support member may not be pivoted through a complete rotation with respect to the mounting arrangement, and a retracted position in which a further support member may be pivoted through a complete rotation with respect to the mounting arrangement.

Preferably, the support bracket Is placed in the retracted position and the first end of the device is placed on a substantially level surface, an underside of the platform may rest directly on the surface.

Conveniently, the support bracket is pivotably attached to the platform.

Advantageously, each of the support members is provided on a support bracket.

Another aspect of the present invention provides a safety device, comprising: a mounting arrangement operable to receive and support a lower portion of a ladder; and a support assembly upon which the device may rest, the support assembly comprising a plurality of elongate support members, each of which has a pair of ground contacting locations on which the device may rest, the support assembly further comprising one or more downwardly extending legs, each of which may be removably attached to one of the support members so that the support member may be supported by the downwardly extending leg rather than resting on one or more of the ground contacting locations of the support member.

In order that the present invention may be more readily understood, embodiments will now be described by way of example, with reference to the accompanying drawings, in which.

Figure 1:
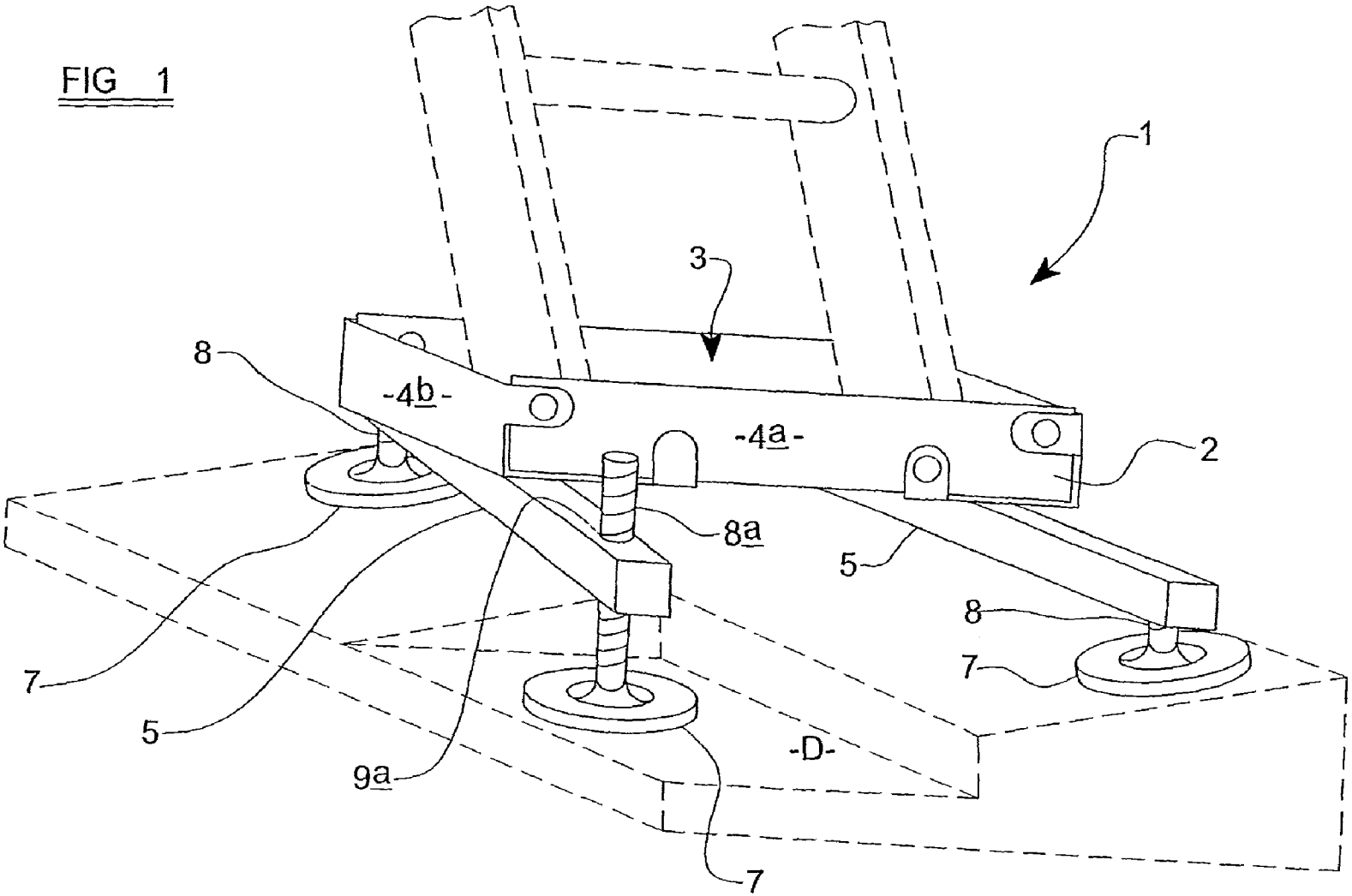
FIG. 1 is a perspective view of a safety device embodying the present invention.

Turning firstly to FIG. 1, a safety device 1 embodying the present invention comprises a platform 2, having a sturdy substantially planar support surface 3, which is rectangular in shape. Side walls 4*a* extend substantially perpendicularly upwards from longer edges of the support surface 3, and end walls 4*b* extend substantially perpendicularly upwardly from shorter edges of the support surface 3. Thus, the support surface 3 is surrounded on all four sides by raised walls 4, which define a channel. This channel is of an appropriate size to receive the lower edges of both stiles of a standard ladder (not shown) such that the channel lies substantially parallel with the rungs of the ladder.

The support surface 3 and side walls 4 of the platform 2 are preferably formed from a sturdy durable material such as steel.

Figure 2:
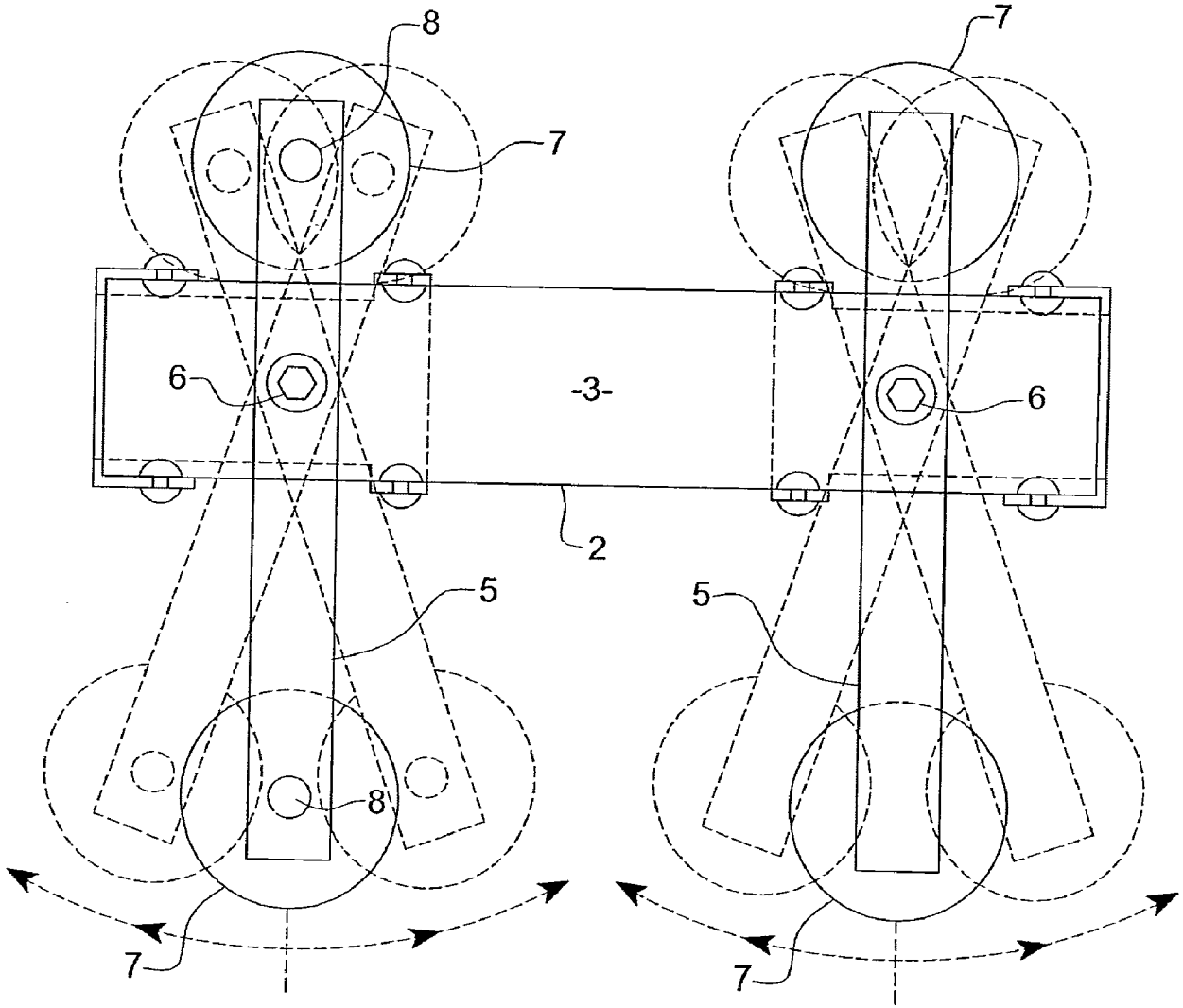
FIG. 2 is a plan view of the safety device of FIG. 1, showing possible movement of support members thereof.

A support assembly is attached to the underside of platform 2, so that the platform 2 rests on the support assembly when placed on level ground in a normal use configuration. The support assembly comprises a pair of elongate support members 5, which are substantially parallel with the underside of the platform 2 and each of which is independently pivotably attached to the underside of the platform 2 (or to separate support brackets, as will be discussed later) by means of a pivot bolt 6 (as can be seen in FIG. 2). In preferred embodiments of the present invention, each support member 5 comprises a sturdy tubular member having a substantially rectangular cross-section formed from a robust and durable material such as steel.

FIG. 2 shows how the support members 5 may pivot with respect to the platform 2. In preferred embodiments of the invention, however, the elongate support members 5 are not restricted to the range of motion shown in FIG. 2, and may rotate through 360° with respect to the platform 2. The length of the support members 5 is such that, in at least some pivotal orientations thereof, each support member 5 may extend outside the area defined by the support surface 3 of the platform 2. Each support member 5 is preferably lockable in a desired pivotal orientation, for instance by tightening a nut which is threaded onto the pivot bolt 6.

In preferred embodiment of the inventions of each support member may be telescopic so that the length thereof may be adjusted.

Each support member 5 has a pair of ground contacting locations, and in preferred embodiments feet 7 are provided on the support members 5 so that the device 1 may rest on the feet 7 when in use. The support members 5 are each pivotably attached to the platform 2 at a location between the ground contacting locations thereof. The feet 7 may be seen most clearly in FIG. 3. In the illustrated example, each foot 7 Is substantially disc-shaped, and covered on at least a lower surface thereof with a rugged, non-slip material such as rubber. In preferred embodiments of the invention, each foot 7 is provided at a lower end of a threaded shaft 8. Preferably, the foot 7 is attached to the shaft 8 In a universally-jointed manner, and a skilled person will appreciate that this will allow the foot 7 to pivot as needed with respect to the shaft 8 and thus rest securely on uneven ground.

An upper end of the threaded shaft 8 is Inserted into a threaded hole 9 which is provided in an underside of the respective support member 5, near an end thereof. Thus, if the device is to be provided with four feet 7, a skilled person will appreciate that each support member 5 will be provided with two threaded holes 9 in the underside thereof, one near each end of the support member 5. In preferred embodiments of the invention, each threaded hole 9 is a hole through a threaded nut which is mounted on a plastic insert, which is pushed into and held within an open end of one of the support member 5.

The threaded shaft 8 carrying a foot 7 is advanced into one of the threaded holes 9 in a support member 5 a desired distance, to attach the foot 7 to the underside of the support member 5.

As an additional safety feature, in preferred embodiments of the invention the threaded shaft 8 is provided at an upper end thereof with a widened portion, (not shown) which is too wide to fit through the threaded hole 9 in the underside of one of the support members 5, and which is located within the body of the appropriate support member 5 It is envisaged that a user may inadvertently attempt to use the device 1 when the threaded shaft 8 of one of the feet 7 is only just inserted Into one of the threaded holes 9 (i.e. by rotating the threaded shaft 8 through only half a turn). Clearly, this would be unsafe, and the provision of the widened portion at the top of the threaded shaft 8 prevents this from occurring.

It will also be seen from, for example, FIG. 1 that two of the threaded shafts 8 pass through threaded hole 9 in the underside of the support members, and terminate within the body of the support member 5 itself. However, the other two threaded shafts 8*a* are substantially longer, and pass through a threaded hole 9 in the underside of one of the support members 5 and subsequently through a further threaded hole 9*a* in a top side of the support member 5. It will be appreciated that feet 7 carried on these longer threaded shafts 8*a* may be disposed substantially lower than other feet 7, by rotating the elongated threaded shaft 8*a* so that almost the whole length thereof protrudes below the support member 5.

As discussed above, a top portion of the elongated threaded shaft 8 may be widened (not shown) so that it may not be passed through either of the threaded holes 9, 9*a* in the support member 5, and not remain above the top surface of the support member 5 as an added safety feature.

In use of the device 1, a user first places the safety device 1 near the foot of a wall, such that the channel of the platform 2 is substantially parallel with the base of the wall. If the ground at the foot of the wall is on a shallow incline, the user may advance the threaded shafts 8 which carry the feet 7 on one side of the device further into the appropriate support member 5 than on the other side of the device 1, thus adjusting the angle of tilt between the platform 2 and the ground, to ensure that the platform 2 is as close as possible to horizontal. If there are bumps, holes or other irregularities on the ground, then the user may need to pivot one or more of the support members 5 to ensure that the feet 7 may be placed on the flattest and/or firmest available parts of the ground. As can be seen from FIG. 1, if there is a depression D in the ground In the vicinity of the device 1, use of one of the elongated threaded shafts 8*a* may be used to allow one of the feet 7 to rest in the depression D, to allow the platform 2 to be as level as possible.

While the device 1 depicted and described above has two support members 5, it is envisaged that devices embodying the present inventions may have a greater number, for instance four, one support member being provided at or near each corner of the platform 2. A skilled person will readily appreciate how this may be achieved.

A spirit level (not shown) or other indicator may be provided on the platform 2 to allow a user to ensure that the platform 2 is as close to horizontal as possible.

The user may then place the lower ends of both stiles of a ladder in the channel of the platform 2, and the raised walls 4 defining the channel will assist in keeping the stiles of the ladder securely In place. The user may then climb the ladder, in greater safety than if the ladder had been placed directly onto the ground at the base of the wall.

Advantageously, one or each support members 5 may be pivotably attached to the underside of the platform 2 at a location which is displaced from the centre of the support member 5. Thus, the or each support member 5 will have one end which projects further from the pivot bolt 6 than the other end. In these embodiments of the invention it is intended that, when the device 1 is placed near the base of a wall (or, of course, any other object or structure) for use in supporting a ladder which is to be leant against the wall, the longer sections of the support members 5 will project away from the wall, thus increasing the overall stability of the device 1. In preferred embodiments of the invention, the support members 5 may pivot through at least 180° so that, whether the ground slopes right-to-left or left-to-right at the base of a wall, the support members 5 may be pivoted so that the longer sections thereof project away from the wall. Each support member 5 may, of course, be attached to the platform 2 at a location at or near the centre of the length thereof.

In addition, the device 1 Is preferably configured so that the support members 5 may be pivoted so that the longer sections of the support members 5 lie underneath, or substantially underneath, the underside of the platform 2. It is envisaged that this will be particularly useful for storage and transportation of the device 1, since the device 1 will occupy a relatively small space when the support members 5 are pivoted into this position.

Figure 4:
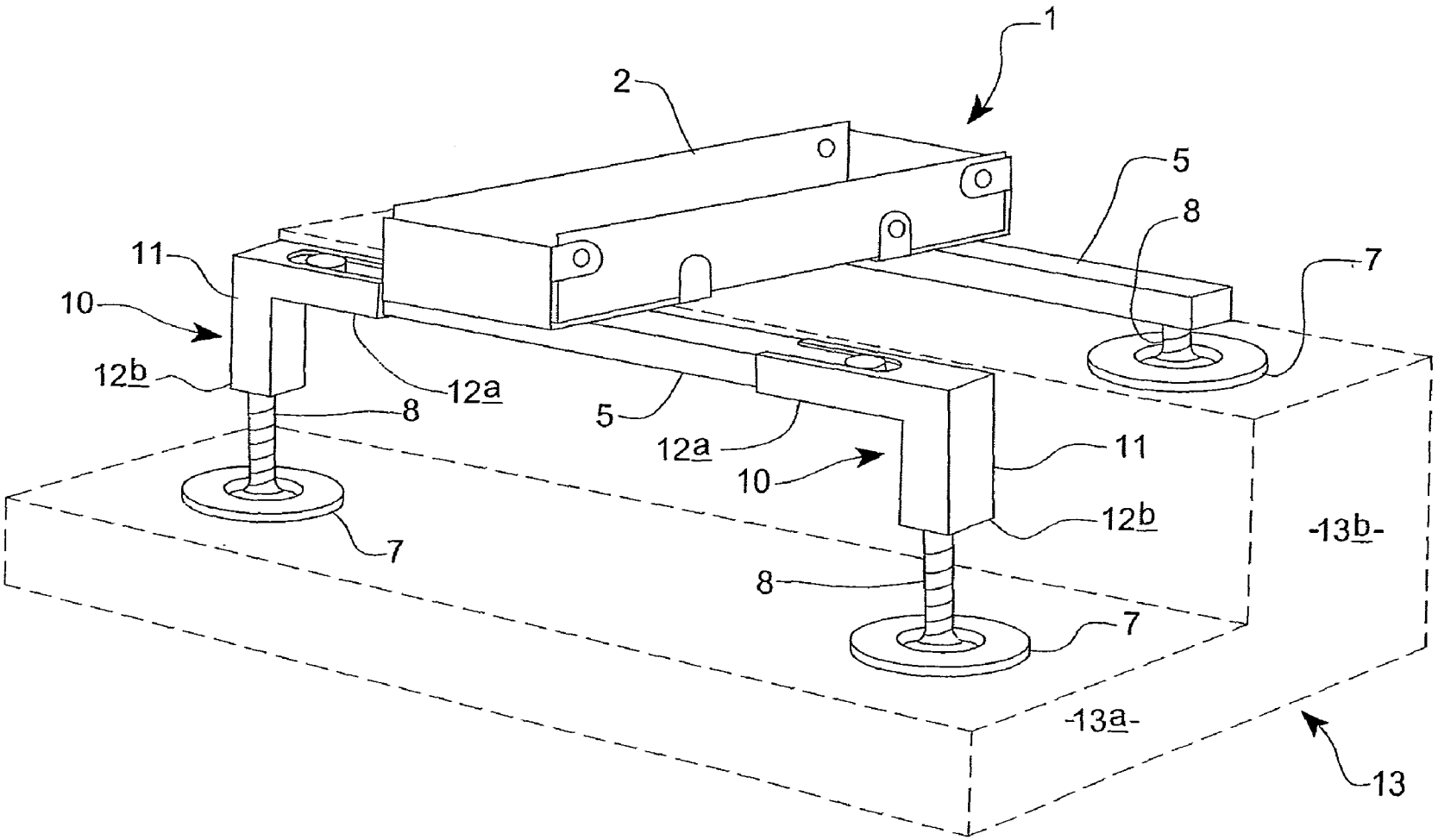
FIGS. 4 and 5 show the safety device of FIG. 1, when adapted for use on a flight of stairs.
Figure 5:
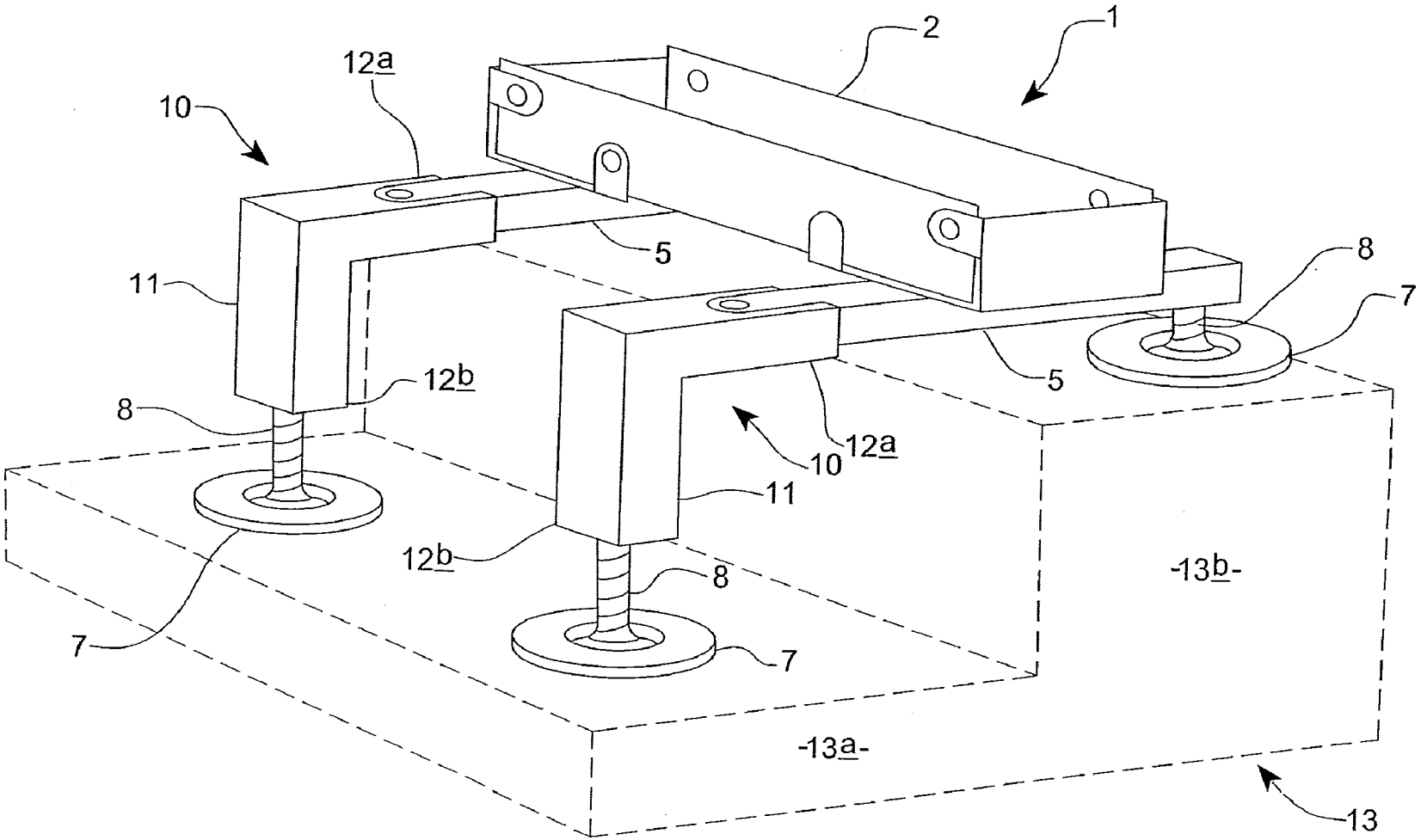

Turning to FIGS. 4 and 5, modifications are shown which allow the device 1 to be utilised more effectively on a flight of stairs.

In FIGS. 4 and 5, two of the feet 7 are each attached to an underside of a support member 5, as described above. In FIG. 4, both of these feet 7 are attached to the underside of the same support member 5, whereas in FIG. 5 these feet 7 are attached to the undersides of different support members 5. The reasons for this will be made clear below.

In FIGS. 4 and 5, in addition to the components described above, two leg elements 10 are provided, on which the support member 5 may rest instead of being supported by one or more of the ground contacting locations thereof. Each leg element 10 comprises a hollow, tubular L-shaped element 11 which has a substantially rectangular cross-section and is open at a first end 12*a* end thereof. The L-shaped element 11 is dimensioned so that an end of either of the support elements 5 may be inserted into the open first end 12*a* thereof, and held in place by means of a catch (not shown) or any other suitable retaining arrangement.

A second end 12*b* of the L-shaped element 11 comprises a threaded aperture (not shown), such that a threaded shaft 8 carrying a foot 7 (as described above) may be threaded into the threaded aperture, so that the threaded shaft 8 is received within and supported by the L-shaped element 11 and is substantially parallel with the length of the second end 12*b* thereof.

As described above, the threaded shaft 8 may terminate at an upper end thereof in a widened portion (not shown), which is located within the body of the L-shaped element 11, so that the shaft 8 may not be removed from the L-shaped element 11. It will be appreciated that this adds to the overall safety of the device 1.

As it will be appreciated from the above, in certain embodiments of the invention the feet 7 which are threaded directly into the undersides of the support members 5 may not be removed from the support members 5. In these embodiments, the leg elements 10 will need to be placed on the ends of one or more support members 5 without interfering with the feet 7 that are attached directly to the support member 5.

In order to achieve this, in preferred embodiments of the invention the first ends 12*a* of the L-shaped element 11 are provided with slots in upper and lower surfaces of the rectangular cross-section thereof. As an end of the support element 5 is inserted into the open first end 12*a* of the L-shaped element 11, the threaded shaft 8 which protrudes from the underside of the support member 5 is received in the slot which is provided in the lower surface of the first end 12*a* of the L-shaped 11 element. If the threaded shaft 8*a* also protrudes through an upper surface of the support member 5, the upper portion thereof will be received in the slot which is provided in the upper surface of the first end 12*a* of the L-shaped 11. This may be seen clearly in FIG. 7.

With reference to FIG. 4, a portion of a flight of stairs 13 is shown, including a lower stair 13*a* and an upper stair 13*b*. In this example, the stairs 13 are beside a wall (not shown), so that the length of each stair 13*a*,13*b* is substantially perpendicular to the base of the wall.

In order to modify the safety device 1 so that a ladder may be leant against the wall, a user simply slots two leg elements 10 on to either end of one of the support members 5, as described above. Alternatively, the feet 7 may be removable from the support member 5. In this instance, the user firstly removes the feet 7 from either end of one of the support members 5, by unthreading the appropriate threaded shafts 8 from the threaded holes 9 in the underside of the support member 5.

It will be appreciated that the feet 7 which are attached to the device 1 by way of the leg elements 10 will be located a substantial distance below the underside of the platform 2, as compared to feet 7 which are attached directly to the underside of a support member 5. The feet 7 which are attached to the device 1 by way of the leg elements 10 are also located further apart from one another than are the feet 7 which are attached directly to the underside of the support member 5, and this will increase the overall stability of the device 1.

It will be appreciated that the device 1 may now be placed on the stairs 13, with the feet 7 that are attached directly to underside of one of the support members 5 being placed on the upper stair 13*b*, and the feet 7 that are attached to the other of the support members 5 by way of the leg elements 10 resting on the lower stair 13*a*. It will be appreciated that the platform 2 will be approximately horizontal, and fine adjustments to the angle of tilt of the platform 2 can be made by advancing or retracting the threaded shafts 8 carrying the feet 7 Into or out of the threaded apertures 9 provided in the underside of the support member 5, or the leg elements 10, to make the platform 2 as close to horizontal as possible.

The user may then rest the lower stiles of a ladder in the channel of the platform 2, and a skilled person will appreciate that this ladder will then be supported in a robust, reliable and level fashion by the safety device 1.

Turning to FIG. 5, the safety device 1 is again placed on a set of stairs 13, including a lower stair 13*a* and an upper stair 13*b*. In this example, however, the length of each stair 13*a*, 13*b* is substantially parallel with the base of the wall, i.e. the wall extends upwardly parallel with an edge of the top stair 13*b*.

In this instance, each support member 5 has one foot 7 attached directly to the underside thereof at one end, and has a leg element 10 attached to the other end thereof, with a foot 7 being attached to the support block 12 of each leg element 10. It will thus be appreciated that the platform may be supported in a substantially horizontal position, but parallel with the length of each stair 13*a*,13*b*, rather than perpendicular thereto (as in the example of FIG. 4).

Although the device 1 described above has two leg elements 10 attached thereto, it is envisaged that one, three or any other number of leg elements 10 may be attached to the device 1.

Figure 7:
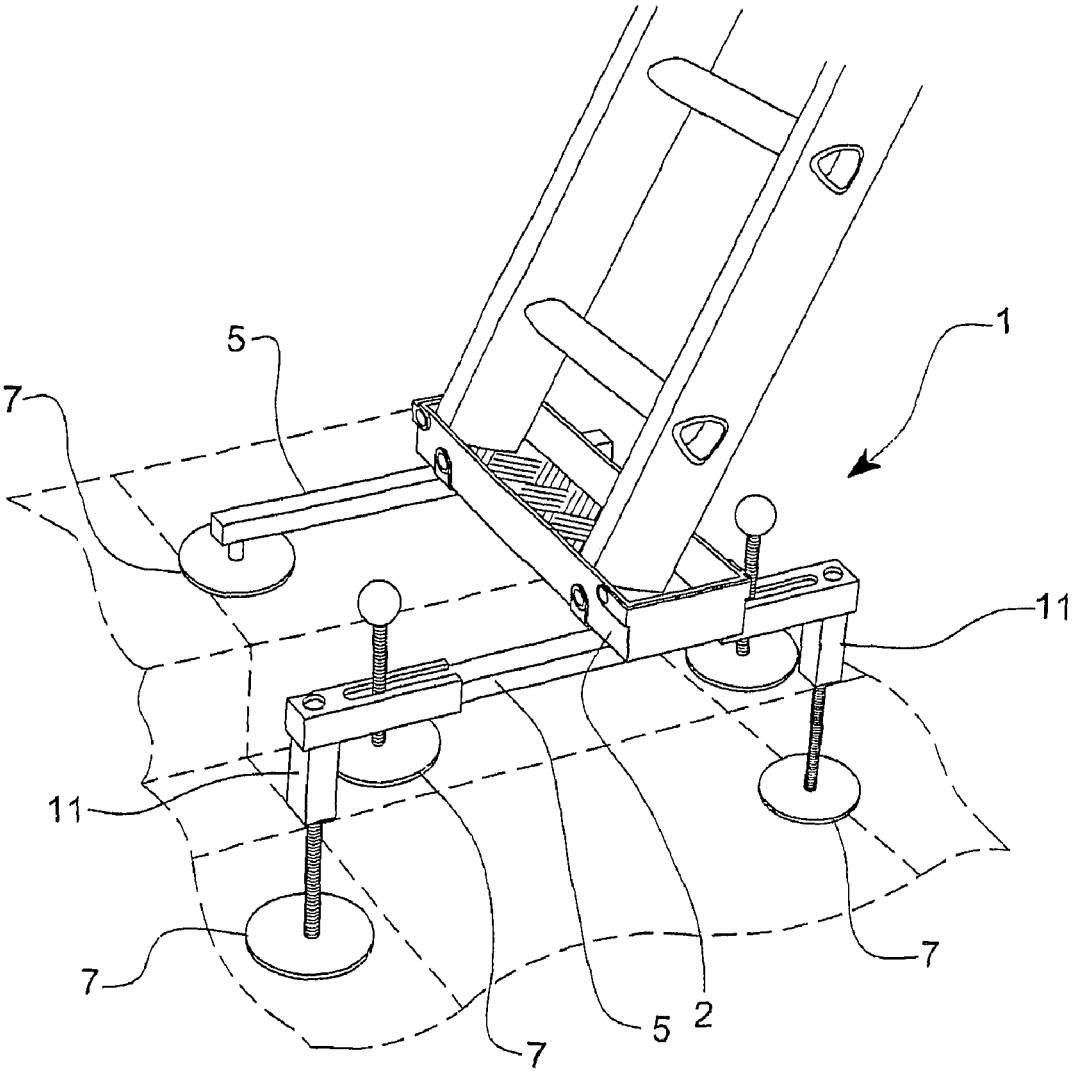
FIGS. 7 and 8 show the device, as configured in FIGS. 4 and 5, in use.
Figure 8:
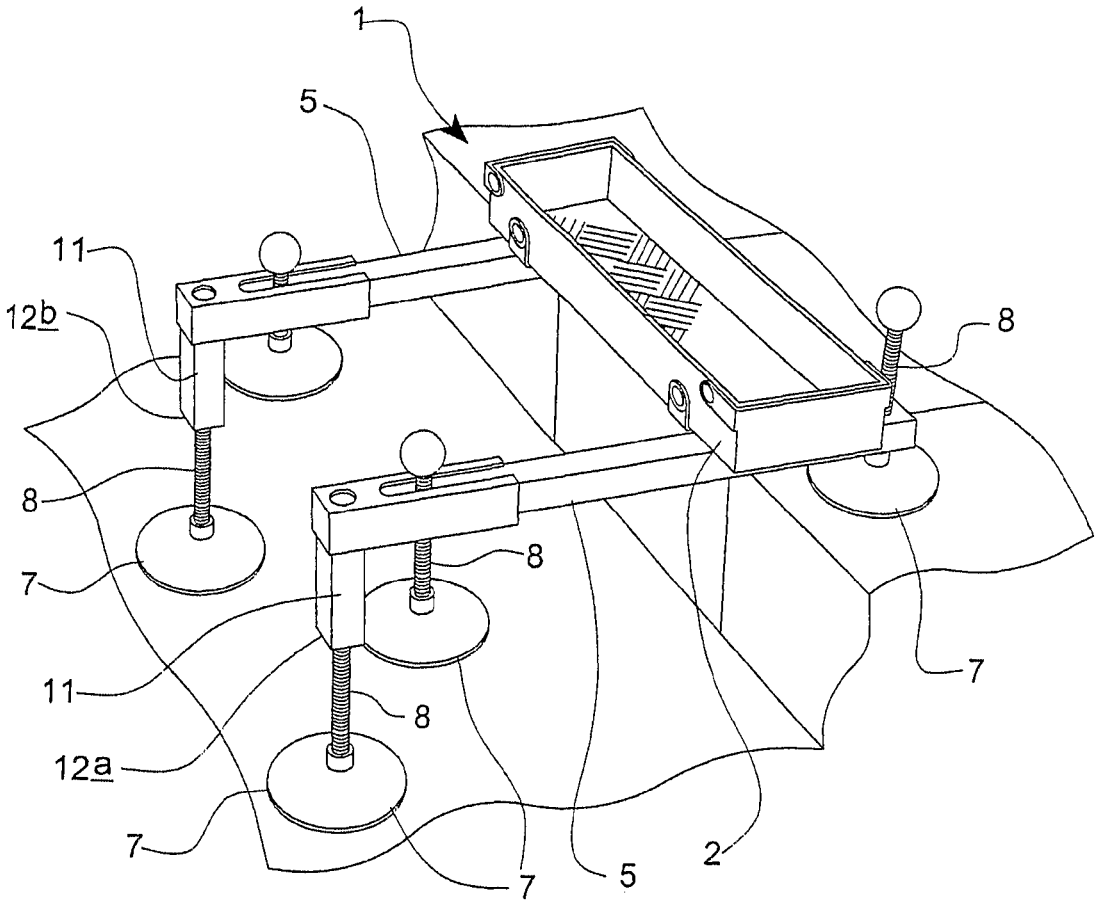

FIGS. 7 and 8 show photographs of the device 1 in use in the above-described configurations.

Figure 6:
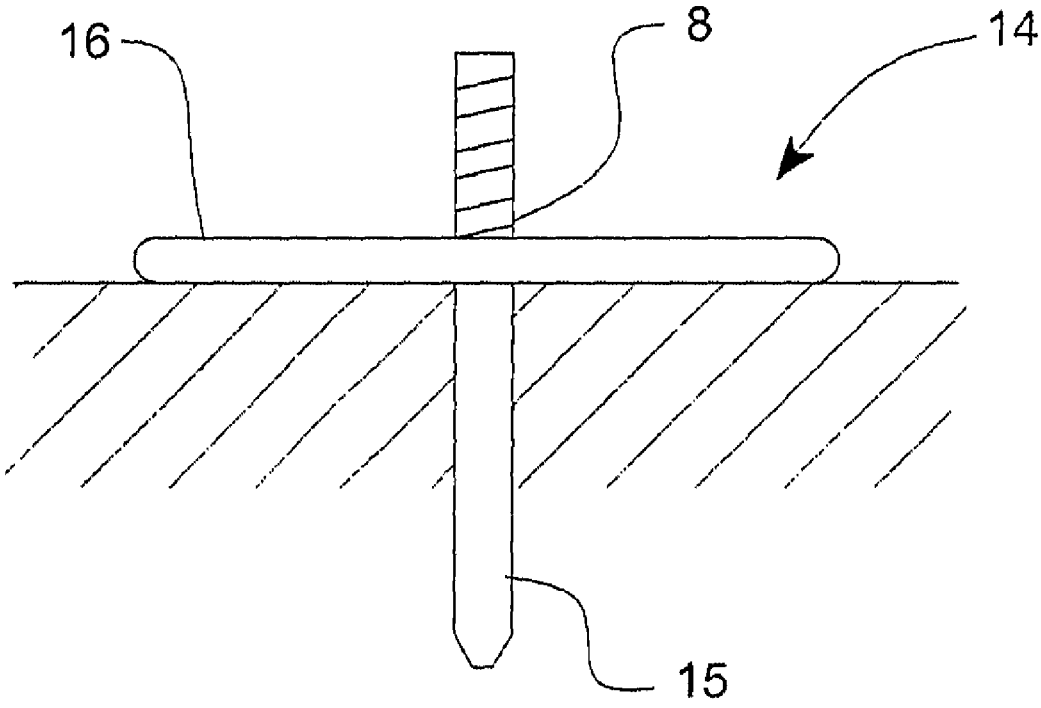
FIG. 6 is a side view of an alternative foot for use with the safety device of FIG. 1.

FIG. 6 shows an alternative foot 14 for use with devices embodying the present Invention. In common with the foot 7 described above, the alternative foot 14 Is carried in a universally-jointed manner on the end of a threaded shaft 8, which may be used to attach the alternative foot 14 to the safety device 1. However, the alternative foot 14 comprises an elongate, robust spike 15 with a flanged collar 16 provided thereon. The alternative foot 14 is intended for use on relatively soft ground, and in use thereof the spike 15 will sink into the ground, and stop sinking when the flange 16 comes to rest on the surface of the ground. It will be appreciated that this alternative foot 14 will provide a very reliable anchor in soft ground.

A skilled person will appreciate that the interchangeability of the feet 7 and alternative feet 14 increases the versatility of the device 1.

In alternative embodiments of the invention, feet are provided as part of individual foot members. In these embodiments, each foot member comprises a block which may be inserted into an open end of one of the support members. A shaft depends downwardly from the block of the foot member, and a foot is provided on the lower end of the shaft. Preferably, a notch is cut into a lower side of the support member, along which the shaft slides when the block is inserted into the open end of the support member.

Each foot element may be secured in place by advancing a screw through a hole in a side surface of the end of the support member, so that the screw presses against the block of the foot element. The shaft of each foot element comprises a threaded shaft which passes through a threaded bore in the block of the foot element. Thus, the shaft may be rotated to adjust the distance between the foot and the support member to which it is attached. In preferred embodiments, an aperture is provided in an upper surface of each end of each support member, to allow the shaft of the foot element to pass upwardly therethrough.

These embodiments of the Invention are advantageous in that foot members may be attached and removed from the support members quickly and easily, and if interchangeable feet are required then these may be provided as part of separate foot elements which may swiftly be swapped with one another as the situation demands. Further, if leg elements (described below) are used with the support members, the foot elements may be attached to lower ends of the leg elements, and it will be appreciated that this system leads to a robust and flexible system.

As described above, the support members 5 may be attached directly to the underside of the platform 2. However, in preferred embodiments of the invention, and as seen most clearly In FIG. 3, the support members 5 may alternatively be provided on support brackets 17. Each support bracket 17 comprises first and second planar elements 18, 19 which are joined to one another at edges thereof at a right angle. In preferred embodiments of the invention, the support bracket 17 may be formed from a single sheet of material (e.g. steel) by forming a 90° bend in the sheet.

The support brackets 17 are positioned at either end of the platform 2, so that the first planar element 18 of each support bracket 17 lies against and covers a part of the underside of the platform 2, and the second planar element 19 of the support bracket 17 lies against and covers at least a part of the outside of an end wall 4*b* of the platform 2. Securing tongues 20 project inwardly from side edges of both the first and second planar elements 18,19, and lie flat against the side walls 4*a* of the platform 2. The securing tongues 20 are secured to the side walls 4*a* by screws, bolts, rivets or any other suitable means.

Figure 3:
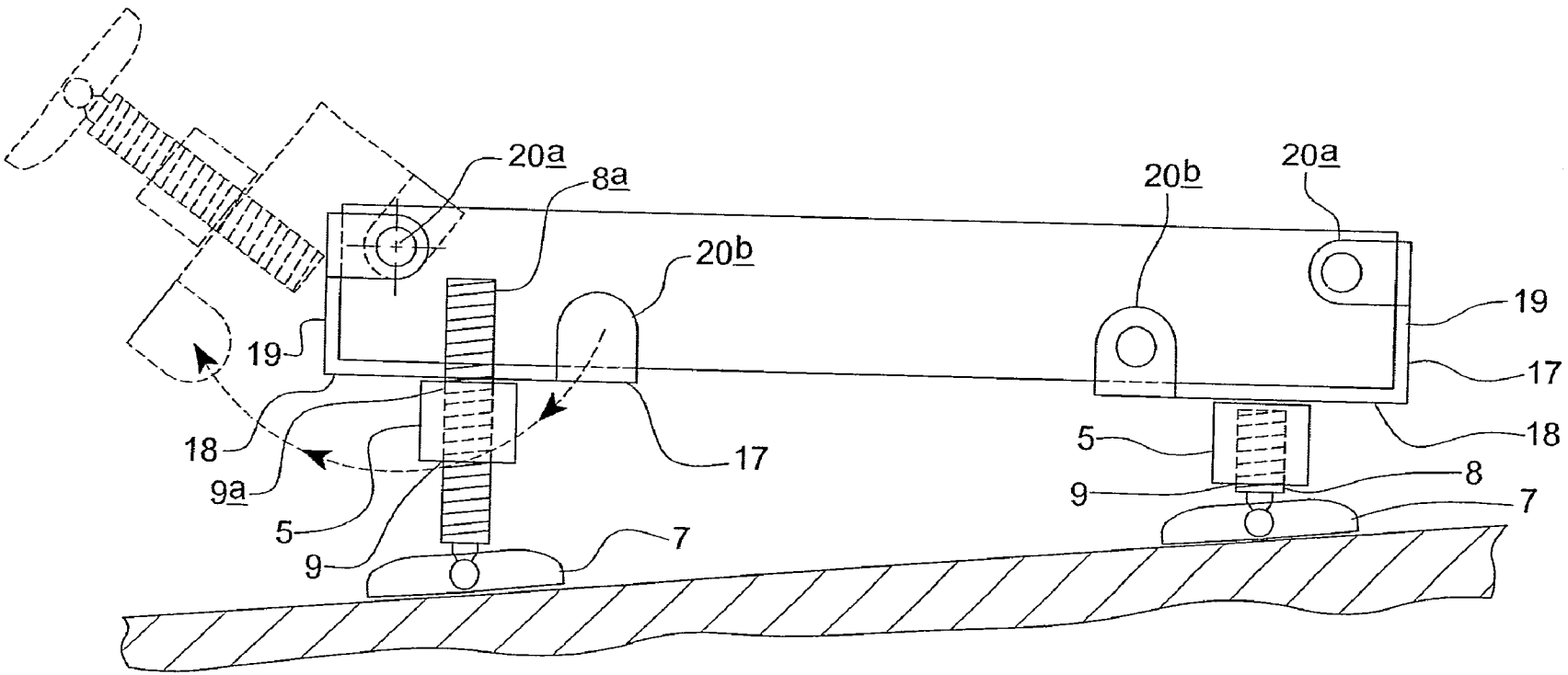
FIG. 3 is a side view of the safety device of FIG. 1.

With reference to FIG. 3, it may be seen that one or both of the support brackets 17 may be attached to the platform 2 In a rotatable fashion, such that the upper securing tongues 20*a* (which project from the second planar member 19) are attached to the side walls 4*a* of the platform 2 in a rotatable fashion, and lower securing tongues 20*b* (which project from the first planar member 18) are not attached to the side walls 4*a* of the platform 2, but simply rest thereagainst for stabilising purposes.

As is shown in phantom in FIG. 3, a securing bracket 17 which is attached to the platform 2 in this manner may be rotated around the upper securing tongues 20*a*, so that the securing bracket 17, a support member 5 attached to the underside thereof and any feet 7 attached to the support member 5 project outwardly and upwardly from the end of the platform 2, allowing support member 5 which is attached to the support bracket 17 to be rotated through 180°. Without this feature, it might be necessary to remove the support member 5 or fully unscrew the threaded shaft 8*a* from the device 1 completely in order to rotate the support member in this way. If, for example, the distance from the pivot point of a support member to any end of the support member is greater than the distance between the pivot points of the support members. It will also be appreciated that the rotation of the support bracket 17 may be required to allow the support member 5 attached to the other end of the platform 2 to be rotated through 180°.

Also, if a user wishes to rest the device 1 on an upper stair and a lower stair (not shown), one of the securing brackets 17 may be rotated in the manner described above, and the end of the platform 2 which carries the rotating support bracket 17 may be placed directly on to the upper step (for this purpose, the underside of the platform 2 may be provided with one or more non-slip pads or feet formed from rubber or other material). The feet 7 which are provided on the underside of the support bracket 17 at the other end of the platform 2 may be placed directly on to the lower stair, thus allowing the platform 2 to be placed in a substantially horizontal position.

When used in combination with the leg elements 10 described above, this feature may allow the device 1 to rest on a pair of stairs having a large disparity in height, and still allow the platform 2 of the device to be in a substantially horizontal orientation.

A skilled person will appreciate that the present invention provides a robust and flexible device which will greatly improve the security and safety of ladders, when used in a variety of different circumstances.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed In their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A safety device, comprising:

a mounting arrangement, comprising an elongate platform, operable to receive and support a lower portion of a ladder; and a support assembly upon which the platform rests, the support assembly comprising a plurality of elongate support members located at least in part underneath the platform, each of which has a pair of ground contacting feet attached thereto on which the platform rests and each of which support member is independently pivotable with respect to the mounting arrangement around a point located between vertical lines passing through the ground contacting feet attached thereto to allow the support members to be pivoted and locked parallel to one another, or alternatively, not parallel to one another, the support members being pivotally mounted to pivot about an axis passing through the platform, wherein the ground contacting feet associated with each support member are located on opposite sides of the support member, are independently height adjustable and connected to the support members in a universally jointed manner to accommodate uneven ground.

2. A device according to claim 1, wherein at least one of the support members is pivotably attached to the mounting arrangement at a point which is displaced from the centre of the length of the support member.

3. A device according to claim 1, wherein the distance between the foot and the support member on which the foot is provided is adjustable.

4. A device according to claim 1, wherein the foot comprises an anchoring device operable to penetrate into a surface on which the device is placed.

5. A device according to claim 4, wherein the anchoring device comprises one or more spikes and a flange, so that penetration of the one or more spikes into the surface will be halted when the flange comes to rest on the surface.

6. A device according to claim 4, wherein the foot is removable from the support member.

7. A device according to claim 4, wherein the foot is not removable from the support member.

8. A device according to claim 1, wherein the support assembly comprises one or more downwardly extending legs, each of which may be removably attached to one of the support members so that the support member may be supported by the downwardly extending leg rather than resting on one of the ground contacting locations of the support member.

9. A device according to claim 8, wherein at least one elongate leg may be attached to extend downwardly from at least one of the support members, thereby allowing the device to rest on a pair of steps of different heights while maintaining the mounting arrangement in a substantially horizontal orientation.

10. A device according to claim 8, wherein the or each elongate leg terminates in a foot.

11. A device according to claim 8, wherein the distance by which the or each leg extends downwardly from the support member to which the leg is attached is adjustable.

12. A device according to claim 8, wherein the or each leg may be replaced, once removed from the support assembly, by a foot.

13. A device according to claim 1, wherein:

the support members are provided near respective first and second ends of the device; and at least one of the support members is provided on a support bracket, which is attached to the platform.

14. A device according to claim 13, wherein:

a support member at or near the first end of the device is provided on a support bracket; and the support bracket may be moved between a support position in which, a further support member may not be pivoted through a complete rotation with respect to the mounting arrangement, and a retracted position in which a further support member may be pivoted through a complete rotation with respect to the mounting arrangement.

15. A device according to claim 14 wherein, when the support bracket is placed in the retracted position and the first end of the device is placed on a substantially level surface, an underside of the platform may rest directly on the surface.

16. A device according to claim 15, wherein the support bracket is pivotably attached to the platform.

17. A device according to claim 13, wherein each of the support members is provided on a support bracket.

18. A device according to claim 1, wherein the support members are each directly pivotally attached to the platform.

* * * * *